United States Patent [19]

Boiten

[11] 3,967,374

[45] July 6, 1976

[54] SHAVING HEAD FOR A DRY-SHAVING APPARATUS

[75] Inventor: Ebbe Boiten, Drachten, Netherlands

[73] Assignee: U.S. Philips Corporation, New York, N.Y.

[22] Filed: Mar. 27, 1975

[21] Appl. No.: 562,493

[30] Foreign Application Priority Data

Apr. 25, 1974 Netherlands ..... 7405554

[52] U.S. Cl. ..... 30/43.92

[51] Int. Cl.[2] ..... B26B 19/04

[58] Field of Search..... 30/43.7, 43.8, 43.9, 30/43.91, 43.92, 346.51

[56] References Cited

UNITED STATES PATENTS 3,855,697 12/1974 Meyer ..... 30/43.92 X

FOREIGN PATENTS OR APPLICATIONS 2,049,166 4/1971 Germany ..... 30/346.51

302,995 11/1954 Switzerland..... 30/43.92

*Primary Examiner*—Al Lawrence Smith

*Assistant Examiner*—Gary L. Smith

*Attorney, Agent, or Firm*—Frank R. Trifari; J. David Dainow

[57] ABSTRACT

A detachable shaving head for a vibrator dry shaving apparatus including a cap, a thin shear plate with hair-entrance apertures disposed in the cap, and a cooperating cutter disposed on a pivotable carrying frame which can be latched in the cap. A single spring means urges the latch to lock and urges the cutter into engagement with the shear plate.

10 Claims, 3 Drawing Figures

SHAVING HEAD FOR A DRY-SHAVING APPARATUS

BACKGROUND OF THE INVENTION

The invention relates to a detachable shaving head for a vibrator dry-shaving apparatus, which includes:

a cap provided with a rectangular opening, a thin flexible shear plate provided with hair entrance apertures, which is attached to the long sides of the rectangular opening in arcuated form, and a cutting block provided with a multiplicity of cutters with arcuated cutting edges whose shape is in accordance with the arcuation of the shear plate.

pressure springs which press the cutting block into the arcuation of the shear plate, a hingeable carrying frame which is pivoted to the cap, which frame carries the pressure springs and the cutting block and forms a unit therewith, and latching means for latching the carrying frame in the cap in its operating position, which latching means are only accessible by hand when the shaving head is removed from the shaving apparatus.

From Netherlands patent application No. 7,014,748, which has been laid open for public inspection, such a detachable shaving head is known. The hinged connection between the carrying frame and the cap is formed by a hinge pin, which extends in the longitudinal direction of the carrying frame and which at its ends is connected to the sides of the cap. The carrying frame is journalled on said hinge pin. The carrying frame is latched in the cap with the aid of a bar which is slidable in recesses transverse to the longitudinal direction of the cap against the action of a rod-shaped spring. The two free conical ends of the bar protrude from the cap and cooperate with corresponding slots in the two side walls of the carrying frame, so that a latching system is formed. For re-setting the bar so as to release the latching system an actuating member is provided which is constituted by recess in the side of the bar which faces the apparatus.

It is an object of the invention to provide a detachable shaving head of the type mentioned in the preamble, in which no separate resilient means are required for latching the carrying frame in the cap, and which allows the carrying frame to be further hinged out of the cap. The invention is characterized in that said latching means also comprise:

hinge arms which at their one end are pivoted to one side of the carrying frame and at their other end to the cap, parts of the cap and the carrying frame which engage in the operating position for the purpose of latching, being disposed at the side of the carrying frame which faces the hinge arms. Furthermore in the operating position of the carrying frame, the connection between the hinge arms and the carrying frame is located nearer the top of the arcuation of the shear plate than the connection line between the points of attachment of the hinge arms to the cap and the point where the engaging parts cooperate with each other for the purpose of latching.

An embodiment of the invention which may be used to advantage is characterized in that two hinge arms are provided which are constituted by the legs of a single substantially U-shaped bracket which is made of metal wire, the base of the U being pivoted to the cap.

Another embodiment allows the carrying frame to be hinged out very far relative to the cap and is characterized in that the hinge arms starting from the operating position, are hingeable relative to the cap through an angle which is greater than 90°, and the hinge arms are of such a length that in the fully hinged-out position the hinged points of attachment between the hinge arms and the carrying frame are located completely outside the cap.

The invention will be described with reference to the drawing,

DETAILED DESCRIPTION OF THE PREFERRED EMBODIMENT

Figure 3:
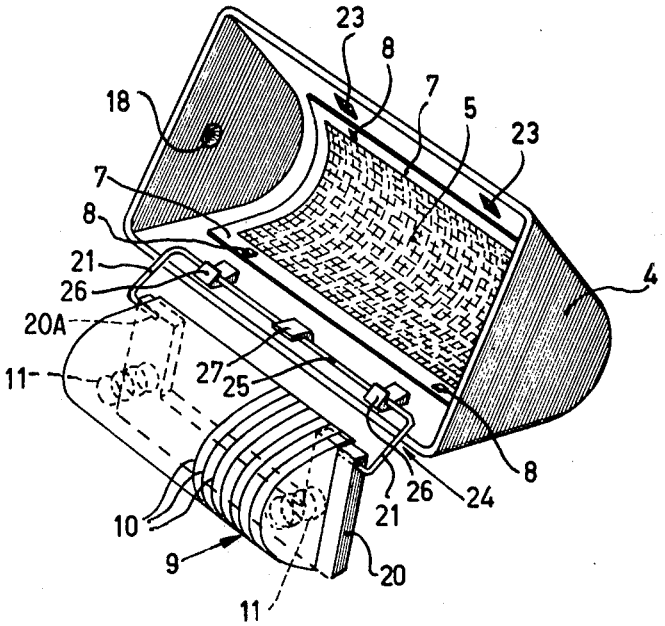
FIG. 3 is a perspective view of the detachable shaving head of the shaving apparatus of FIGS. 1 and 2, the carrying frame with the springs and cutting block mounted thereon being hinged out of the cap.

In the Figures corresponding parts are denoted by corresponding reference numerals. The vibrator dry-shaving apparatus 1 consists of a detachable shaving head 2 and a motor section 3. The shaving head 2 consists of a cap 4, which is provided with a rectangular opening, in which a thin flexible shear plate 5 is disposed. Said shear plate is provided with a multitude of hair entrance apertures 6 and at its long side edges it is provided with strip-shaped reinforcements 7, for which in particular reference is made to FIG. 3. The shear plate is connected to the cap 4 with the aid of hooks 8. Against the underside of the arcuated shear plate 5 a cutting block 9 is pressed, which is provided with a multiplicity of cutters 10 whose arcuated cutting edges correspond in shape to the arcuation of the shear plate. The cutting block 9 is pressed against the underside of the shear plate 5 by means of two helically coiled pressure springs 11.

Figure 1:
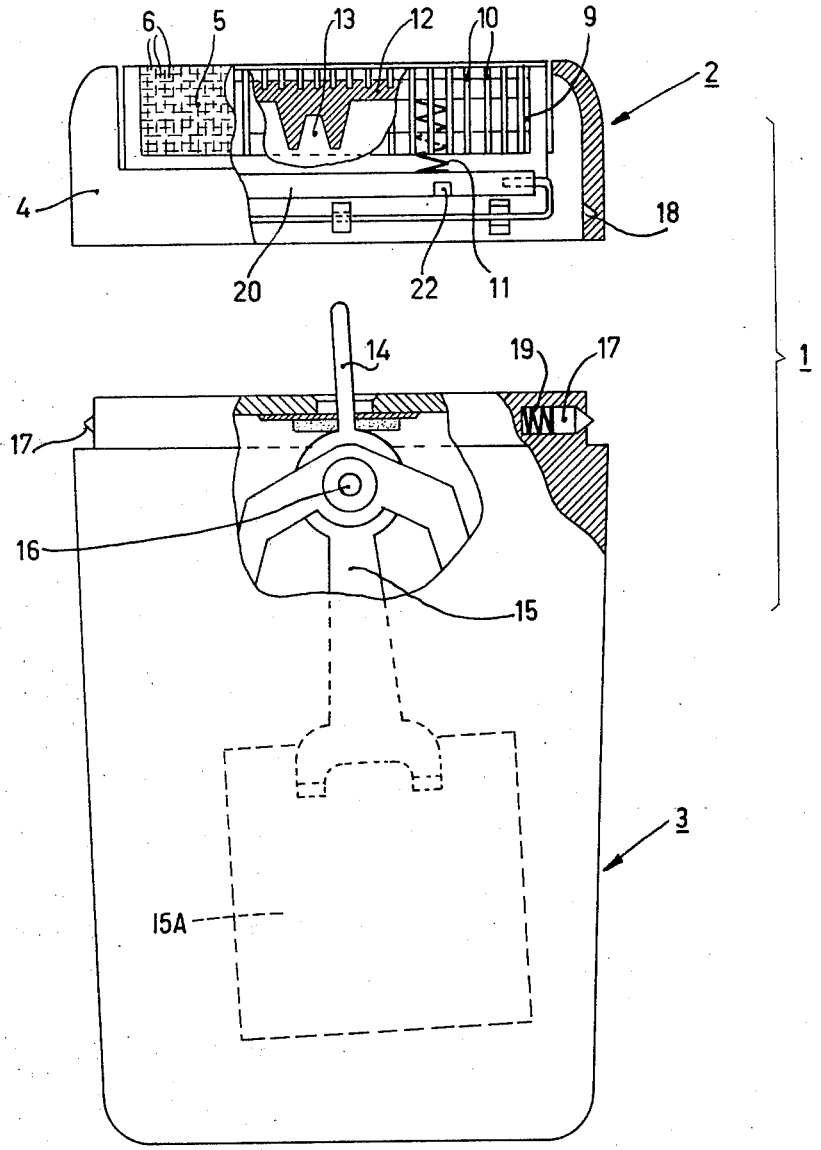
FIG. 1 shows a vibrator shaving apparatus with a detachable shaving head at some distance from the other part of the shaving apparatus.

The cutting block 9 consists of an aluminium frame or base 12 in which the lamellar steel cutters cast-in. The underside the aluminium frame is provided with a coupling slot 13 which is adapted to co-operate with the drive pin 14 of a vibrator motor which is accommodated in a housing 3. In FIG. 1 the armature 15 of such motor is shown, which can oscillate about the armature stud 16 and has drive pin 14 extending upward.

The cap 4 can be disposed on the motor section 3 in which situation the drive pin 14 engages the coupling slot 13, so that the cutting block 9 is reciprocatable by the armature 15. The cap 4, when fitted on the motor section, is latched by two spring-loaded latching pins 17 which are provided with a conical tip. The conical tip co-operates with corresponding recesses 18 at the inside of the cap 4 and is pressed therein by the pressure springs 19 when the cap is fitted.

A hingeable carrying frame 20 is pivoted to the cap 4. Said frame carries the pressure springs 11 and the cutting block 9 and forms a unit therewith. For this purpose the springs 11 are suitably connected to the carrying frame 20 at the one side and to the aluminium frame 12 of the cutting block at the other side. According to the present state of the art various possibilities exist, the springs may for example be clamped onto projecting parts of the frame 20 and the frame 12. The carrying frame 20 can be latched in the cap in its operating position with the aid of latching means which are only accessible by hand when the shaving head is removed from the shaving apparatus. Said locking means include two hinge arms 21 which at their one end are pivoted to one side of the frame 20 and at their other end to the cap 4. Furthermore, the carrying frame 20 at its side opposite the hinge arms is provided with two latching cams 22 which cooperate with corresponding recesses 23 at the inside of the cap 4. The hinge arms 21 are constituted by the legs of a single substantially U-shaped bracket 24 made of metal wire, whose base 25 is pivoted to the cap 4 with the aid of two more outwardly disposed identical bearing cams 26 and a differently shaped bearing cam 27 which is disposed midway between them. Said bearing cams are substantially hook-shaped, the open side of the hook of the outermost cams 26 substantially facing the opposite side of the shaving cap and the open side and the open side of the hook-shaped cam 27 facing the underside of the cap. The base 25 can be fitted into the hook-shaped cams owing to the deformability of said part. In the operating position of the carrying frame 20, as can be seen in FIG. 2, the connection 20A between the hinge arms 21 and the carrying frame 20 is located nearer the top of arcuation of the shear plate 5 than the connection line along 25 between the bearing cams 26 and 27, which form the connection line between the points of attachment of the hinge arms 21 and the cap 4.

Figure 2:
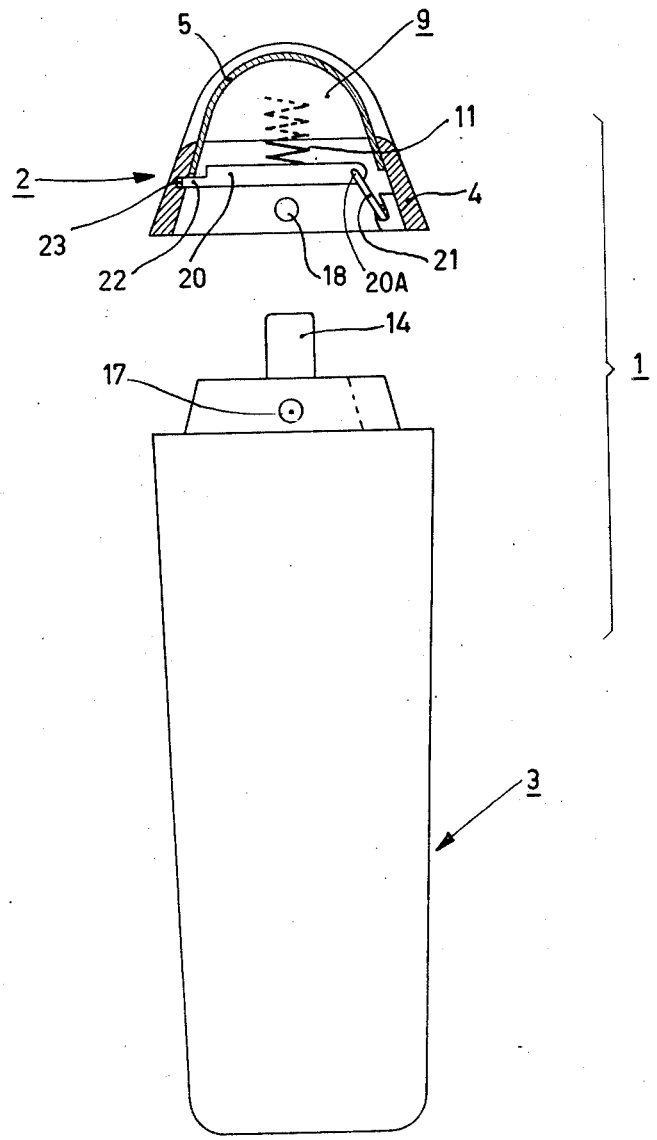
FIG. 2 shows a side view of the shaving apparatus of FIG. 2, the shaving head being shown in sectional view.

It will be evident from FIG. 2 that the pressure springs 11, which serve for pressing the cutting block 9 against the shear plate 5, also function as resilient means for latching the carrying frame 20. The springs 11 press the latching cams 22 against the edges of the corresponding recesses 23 in the cap and, moreover, the two hinge-arms 21 are more or less spring-loaded in their longitudinal direction. For releasing the carrying frame it suffices that the user exerts pressure on the underside of the carrying frame 20 with a finger, while the cap is removed. As a result, the springs 11 are slightly depressed so that the frame 20 can be slightly pivoted and the latching cams 22 can be disengaged from the recesses 23. After this the carrying frame can be hinged out, see FIG. 3 in particular.

In the embodiment shown the hinge arms 21 can be tilted through an angle which is substantially greater than 90°. Moreover, they have such a length that in the fully hinged-out position the point where the arms 21 are pivoted to the carrying frame 20 is located completely outside the cap 4. Thus the cutting block and also the shear plate 5 afford optimum accessibility.

What is claimed is:

1. In a dry shaving apparatus including a housing, a motor with a drive member in said housing, a shaving head which is detachably mounted on said housing and includes a cap having first and second opposite side walls, a top part and an open bottom part, a shear plate with hair-receiving apertures therein at said top part, a cutter having a base and a plurality of blades for engaging and cooperating with said shear plate for cutting hairs extending through said shear plate apertures, and coupling means on said base for engaging said drive member, the improvement in combination therewith, of a frame for supporting said cutter within said cap, said frame having first and second opposite sides corresponding to said first and second side walls of said cap, spring means extending between and engaging said frame and said base of the cutter, pivotable hinge means comprising a body part, a first pivot connection engaging said first side of said cap and a second pivot connection engaging said first side of said frame, latch means comprising first and second parts on said second sides of said frame and cap respectively, said frame being pivotable between operative position and open position, said frame when in operative position, being disposed within said cap with said spring means compressed and urging said cutter blades against shear plate, said spring also urging said first and second parts of said latch means into releasable locking engagement, and said frame when in open position, being completely outside the cap.

2. Apparatus according to claim 1 wherein said body part of said hinge means comprises a wire having two generally parallel and spaced-apart segments, and said first and second pivot connections comprise means on said cap and frame respectively, pivotally engaging said wire segments.

3. Apparatus according to claim 2 wherein said body part comprises at least a partial loop.

4. Apparatus according to claim 3 wherein said body part comprises a [ shape.

5. Apparatus according to claim 1 wherein said cutter blades comprise arcuate cutting edges, and said shear plate is a thin, flexible member formed into an arc corresponding to said cutting edges.

6. Apparatus according to claim 1 wherein said hinge means, when the frame is in its operative position, has its second pivot connection nearer said top part of the cap than said first pivot connection.

7. Apparatus according to claim 1 wherein one of said first and second parts of the latch means comprises a projection and the other part comprises a recess, and said spring means urges the projection into said recess, when the frame is in its operative position.

8. Apparatus according to claim 6 wherein said frame is pivotable from said operative position within said cap, further into said cap for dis-engaging said latch means and permitting frame to then be pivotable out of said cap to its open position.

9. Apparatus according to claim 1 further comprising second latch means for releasably coupling said shaving head onto said housing.

10. Apparatus according to claim 1 wherein said hinge means comprises an arm extending between said first and second pivot connections, said arm being pivoted through an angle >90° as said frame pivots from its operative to open position.

* * * * *